US006213620B1

(12) United States Patent
Huang

(10) Patent No.: US 6,213,620 B1
(45) Date of Patent: Apr. 10, 2001

(54) ASSEMBLED OPENER WITH AN ILLUMINATION DEVICE

(76) Inventor: Sunny (En-Liung) Huang, 786 Via Monte Video St., Claremont, CA (US) 91711

( * ) Notice: Subject to any disclaimer, the term of this patent is extended or adjusted under 35 U.S.C. 154(b) by 0 days.

(21) Appl. No.: 09/339,119

(22) Filed: Jun. 24, 1999

(51) Int. Cl.[7] ..... B25B 23/18
(52) U.S. Cl. ..... 362/119; 362/120
(58) Field of Search ..... 362/109, 119, 362/120, 202, 208, 253

(56) References Cited

U.S. PATENT DOCUMENTS 5,477,434 * 12/1995 Reed ..... 362/119
5,882,103 * 3/1999 Brantley et al. ..... 362/119
5,913,596 * 6/1999 Lin ..... 362/120
6,030,090 * 2/2000 Huang ..... 362/109

* cited by examiner

*Primary Examiner*—Y. Quach
(74) *Attorney, Agent, or Firm*—Jacobson, Price, Holman & Stern, PLLC

(57) ABSTRACT

An assembled opener with an illumination device including a handle, a linkage portion, and a tool portion. An illuminating device is installed within the linkage portion for forming an assembled opener with an illumination device. A polygonal combining groove is formed on the rear side of the front portion of the linkage portion. A hole penetrating to the embedding head is formed in the center of the combining groove, while the front end of the rear portion has a junction with respect to the combining groove. The depth of the junction is shorter than that of the combining groove for a lamp and battery set, sequentially installed therebetween. In addition, a through hole is formed in a center of the tool portion. When the front portion and rear portion of the linkage portion are combined in a predetermined position, the lamp set is actuated for use.

4 Claims, 7 Drawing Sheets

ASSEMBLED OPENER WITH AN ILLUMINATION DEVICE

FIELD OF THE INVENTION

The present invention relates to an assembled opener having an illumination device, and especially relates to an assembled opener having a simple structure, which may be assembled easily, thereby, the front portion of a tool portion has a preferred illumination so that a user may easily operate a screw.

BACKGROUND OF THE INVENTION

A prior art assembled opener with an illumination device is shown in FIG. 7. The primary structure thereof includes a handle a, a linkage portion b, and a tool portion c. The tool portion c may be a flat head opener, a cruciform opener, or a hexagonal opener, for example. An embedding head is installed in front of the handle a, which serves to directly or indirectly be combined with the tail portion of the linkage portion b. Another embedded head at the other end of the linkage portion b is for combining with the tool portion c. Therefore, a practical manual tool is formed.

The linkage portion is a hollow cylinder, and the rear end thereof is installed with a lamp set d. The front end of the lamp set d has a light guide structure e. The light guide structure has a defect in that due to the construction of the linkage portion b, while light within the linkage portion b transmits to the tool portion c from the light guide structure e (or a trench in the lateral side), a part of the light will be blocked by the tool portion c, and thus a shadow is formed. This is a defect in need of improvement.

SUMMARY OF THE INVENTION

Accordingly, the object of the present invention is to provide an assembled opener having an illumination device such as a lamp installed in the assembled opener. After the lamp is actuated, light will pass through a plurality of through holes of the front portion thereof and the tool portion so as to project to a screw head to be rotated, thus no shadow area is formed and the user may conveniently operate a screw.

Another object of the present invention is to provide an assembled opener with an illumination device having a simple structure. The battery can be easily changed and the lamp is easily enabled and disabled.

In order to attain the aforementioned objects, the present invention provides an assembled opener with an illumination device comprising a handle, a linkage portion, and a tool portion, wherein an illumination device is installed within the linkage portion for forming an assembled opener with an illumination device. A polygonal combining groove is formed on the rear side of the front portion of the linkage portion and a hole penetrating to the embedding head is formed on the center of the combining groove. The front end of the rear portion has a junction with respect to the combining groove, the depth of the junction being shorter than that of the combining groove. Thus, a lamp set and a battery set, are sequentially installed therebetween. In addition, a through hole is formed on the center of the tool portion.

By the aforementioned structure, when the front portion and rear portion of the linkage portion according to the present invention are combined in a predetermined position, the lamp set of the present invention will be actuated. Then, light will pass through the through holes of the front portion and the tool portion, avoiding a shadow area for convenient use. Moreover, an insulating cover covers the outer side of the battery. Other than the aforementioned insulating effect, batteries can be connected in series regardless of the number of the batteries. Thus the user may conveniently remove and replace the batteries. Moreover, manufacturing costs can be greatly reduced.

The present invention will be better understood and its numerous objects and advantages will become apparent to those skilled in the art by referencing to the following drawings in which:

DETAILED DESCRIPTION OF THE PREFERRED EMBODIMENTS

Figure 1:
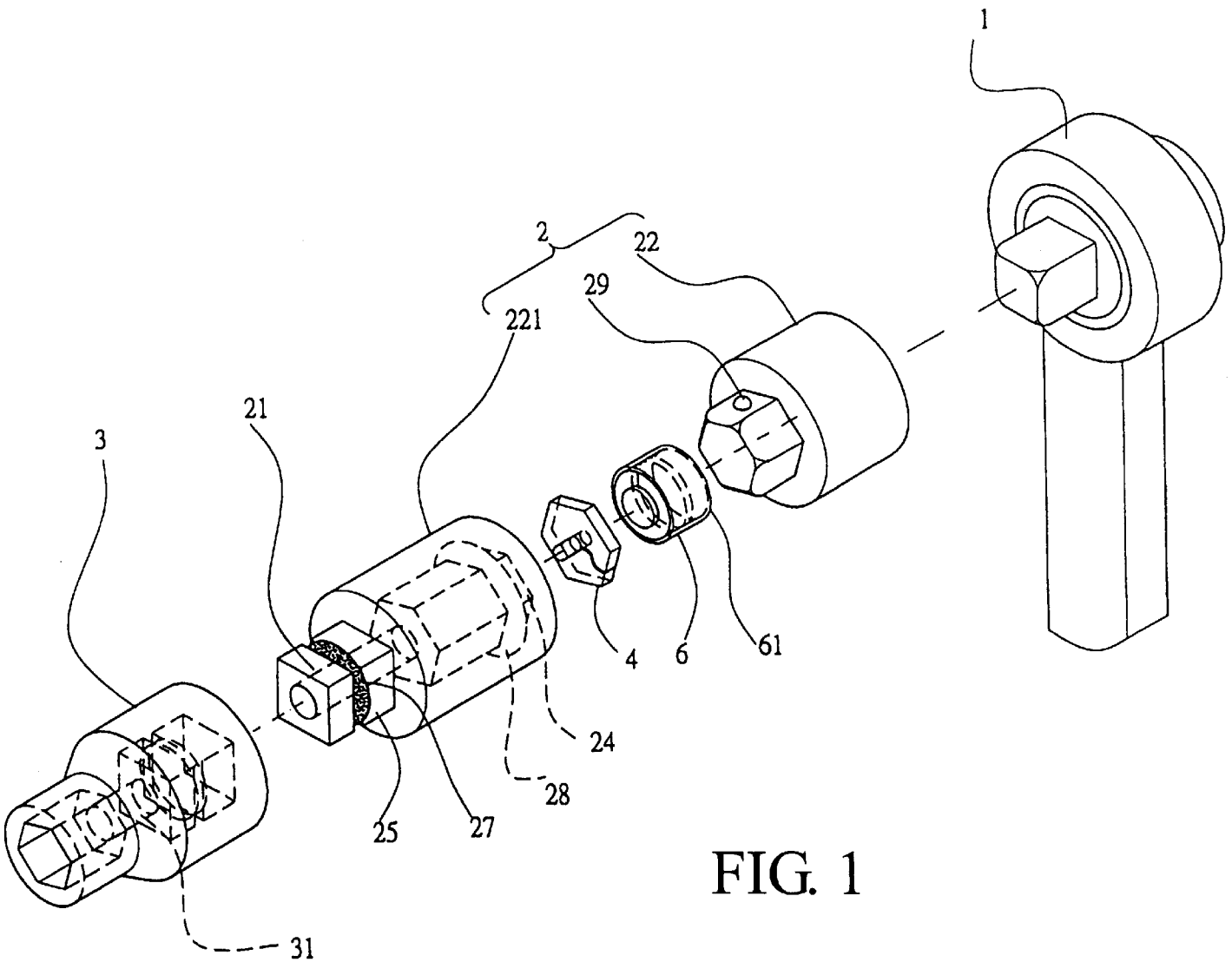
FIG. 1 is a schematic perspective, exploded view of the embodiment according to the present invention.
Figure 2:
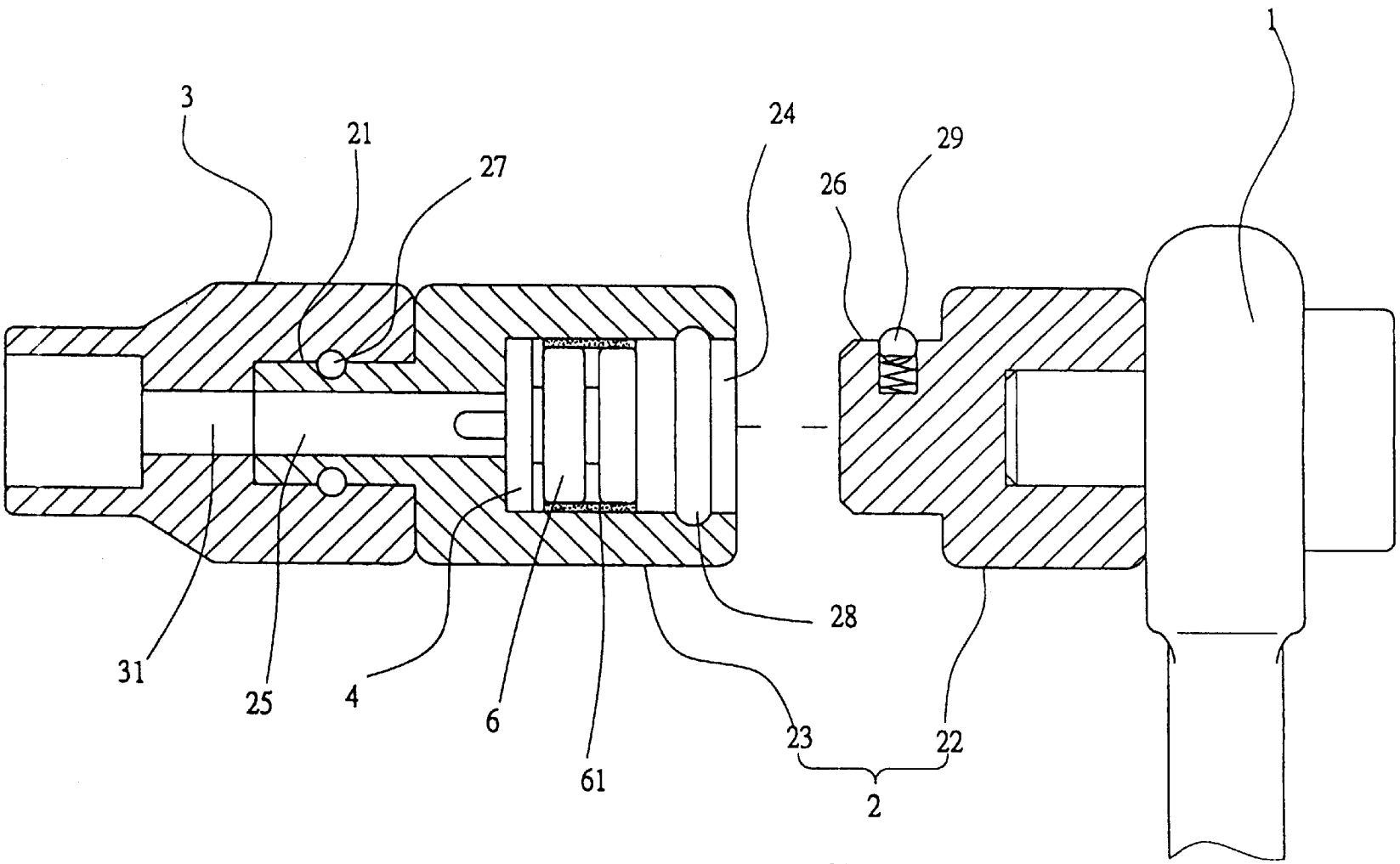
FIG. 2 is an assembled cross sectional view of the present invention.

With reference to FIGS. 1 and 2, the assembled opener with an illumination device of the present invention is illustrated. The opener of the present invention primary includes a handle 1, a linkage portion 2, and a tool portion 3. An illumination device is installed therewithin for forming an assembled opener with an illumination device. A polygonal combining groove 24 is formed on the rear side of the front portion 23 of the linkage portion 2. A hole 25 penetrating to the embedding head 21 is formed on the center of the combining groove, while the front end of the rear portion 22 has a junction 26 with respect to the combining groove 24. The depth of the junction 26 is shorter than that of the combining groove 24. Thus, a lamp 4 and a battery set 6 may be sequentially installed therebetween. The outer side of the battery 6 is enclosed by an insulator cover 61. A through hole 31 is formed in the tool portion 3.

By the aforementioned structure, in general, the embedding head of a general sleeve spanner has a structure to buckle the tool portion by steel ball bearings. While in the present invention, the buckling action is performed by a C ring 27 made of a steel line.

Figure 4:
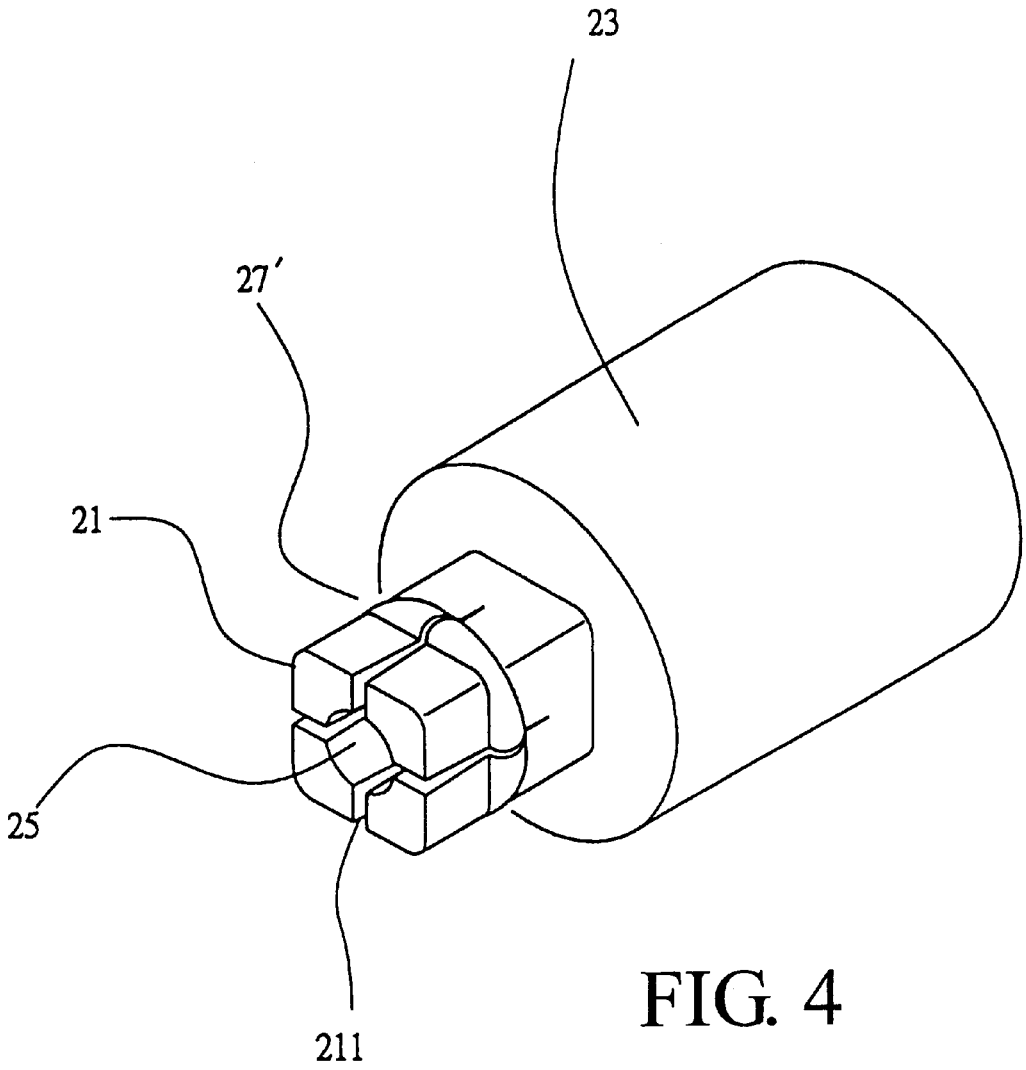
FIG. 4 is another embodiment showing the front portion of the linkage portion according to the present invention.

Of course, an O ring or magnet may be used as a positioning structure during embedding or a plurality of slender slits 211 may be cut in the embedding head 21 as shown in FIG. 4. Then rings 27' made of identical material cover the neck portions, by the elasticity of the hole 25 and the slender slits 211, the ring 27' will firmly buckle the tool portion 3.

In addition, for the positioning of the front portion 23 and rear portion 22 of the linkage portion 2, the front portion 23 and the tool portion 3 may have identical structures. A ring shaped groove 28 is formed in a proper position in the combining groove 24, while the junction of the rear portion 22 is installed with elastic positioning structure 29, including a C ring, an O ring, or a magnet, for example. Therefore, the object of the present invention is achieved.

By the aforementioned description, when the front portion 23 and rear portion 22 of the linkage portion 2 according to the present invention are combined in a predetermined position, the battery 6 is isolated from the insulating cover 61 so that the positive electrode and negative electrode are insulated. Since one conducting end of the lamp 4 directly contacts the head of the battery 6, the tail of the battery 6 will be connected with the lamp by the pressing of the junction of the rear portion 22. Thus, the lamp 4 and the battery 6 are electrically connected and thus the lamp lights up. After the lamp 4 is actuated, light will pass through the through holes 25 and 31 of the front portion 23 thereof and the tool portion 3 so as to project to a screw head to be rotated, thus no shadow area is formed and the user may conveniently operate the tool.

Figure 3A:
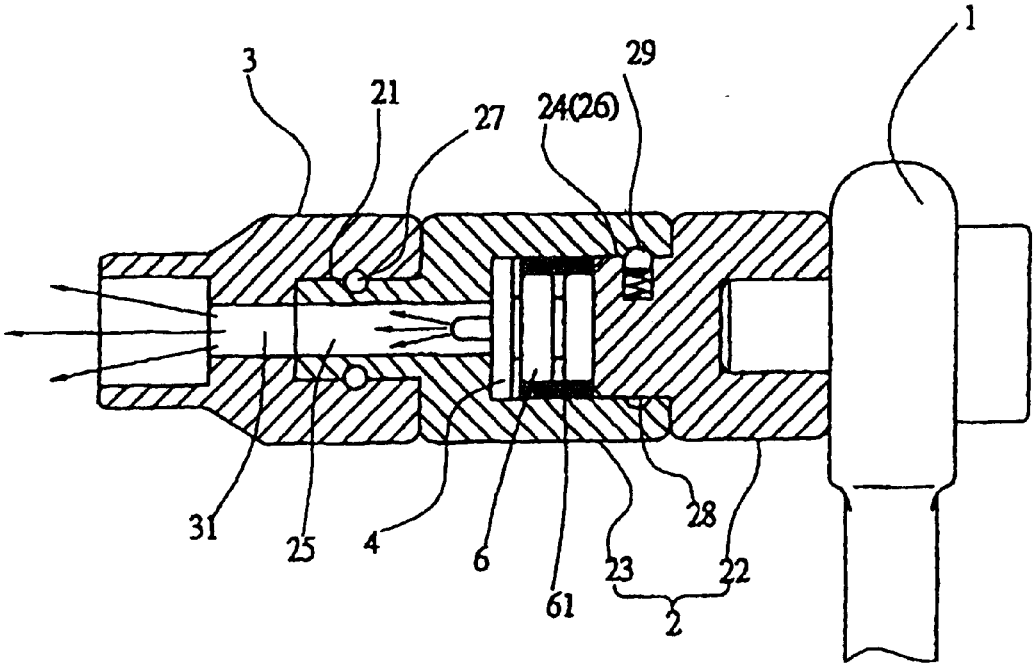
FIG. 3*a* is a cross sectional view showing that the present invention is assembled to a predetermined position.
Figure 3B:
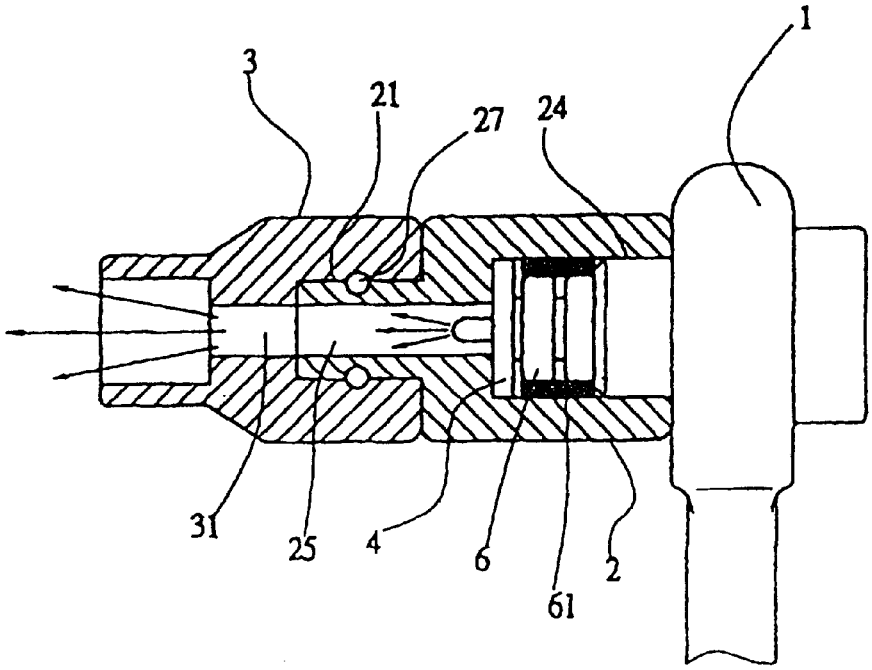
FIG. 3*b* is another embodiment of FIG. 3*a* according to the present invention.

Further, referring to FIG. 3*b*, the linkage portion 2 can be unitary through another construction so that the front portion of the handle 1 is directly encased in the combining groove 24 of the linkage portion 2 and will contact the battery 6 so as to achieve the object of the present invention.

Further referring to FIG. 1, an insulating cover 61 covers the outer side of the battery 6, and in addition to the aforementioned insulating effect, batteries can be connected in series regardless of the number of batteries. Thus, a user may conveniently remove and replace the batteries. Moreover, manufacturing costs can be reduced greatly.

Figure 5:
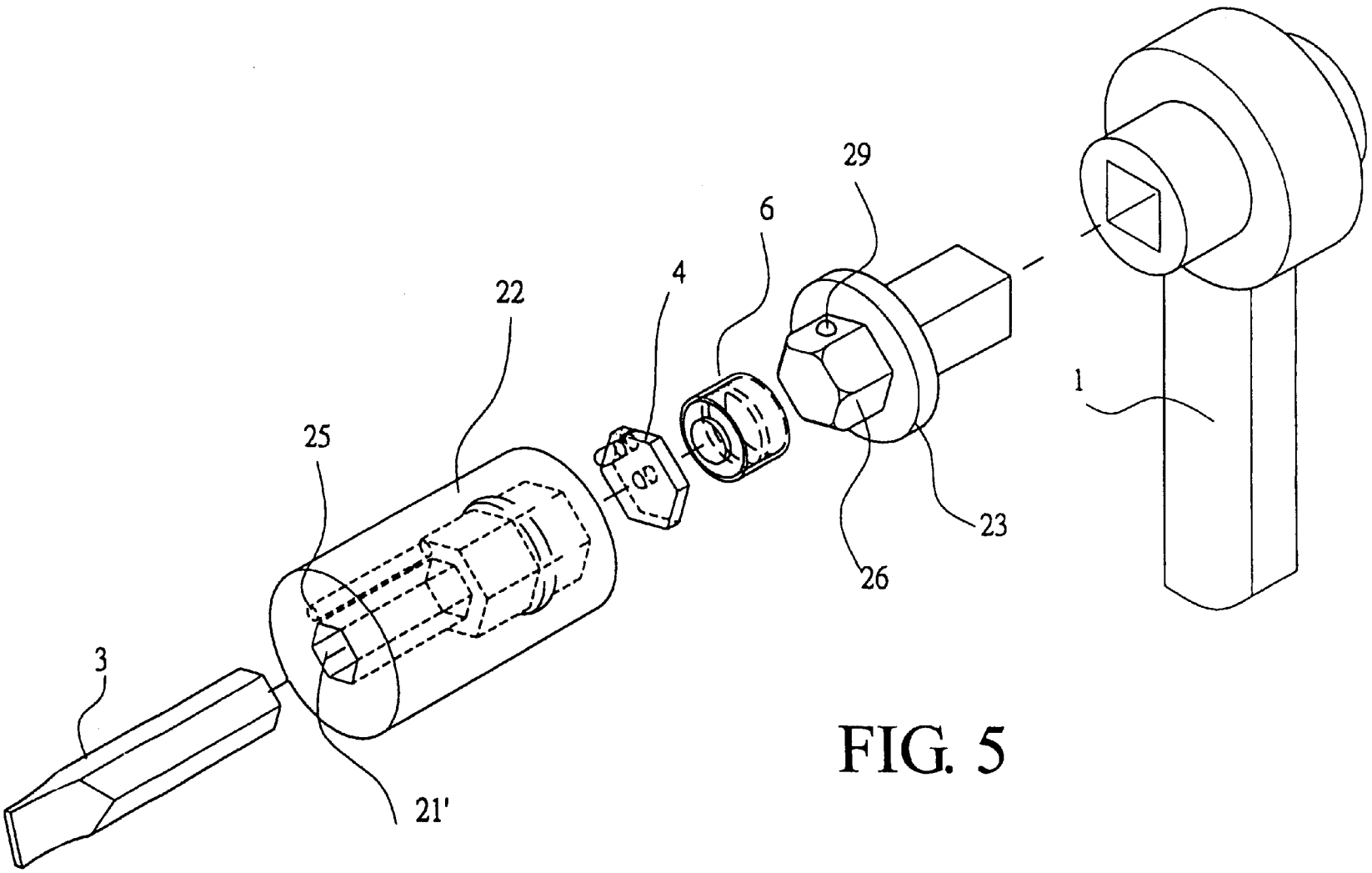
FIG. 5 is a perspective, exploded view of the linkage portion in one embodiment of the present invention.
Figure 6:
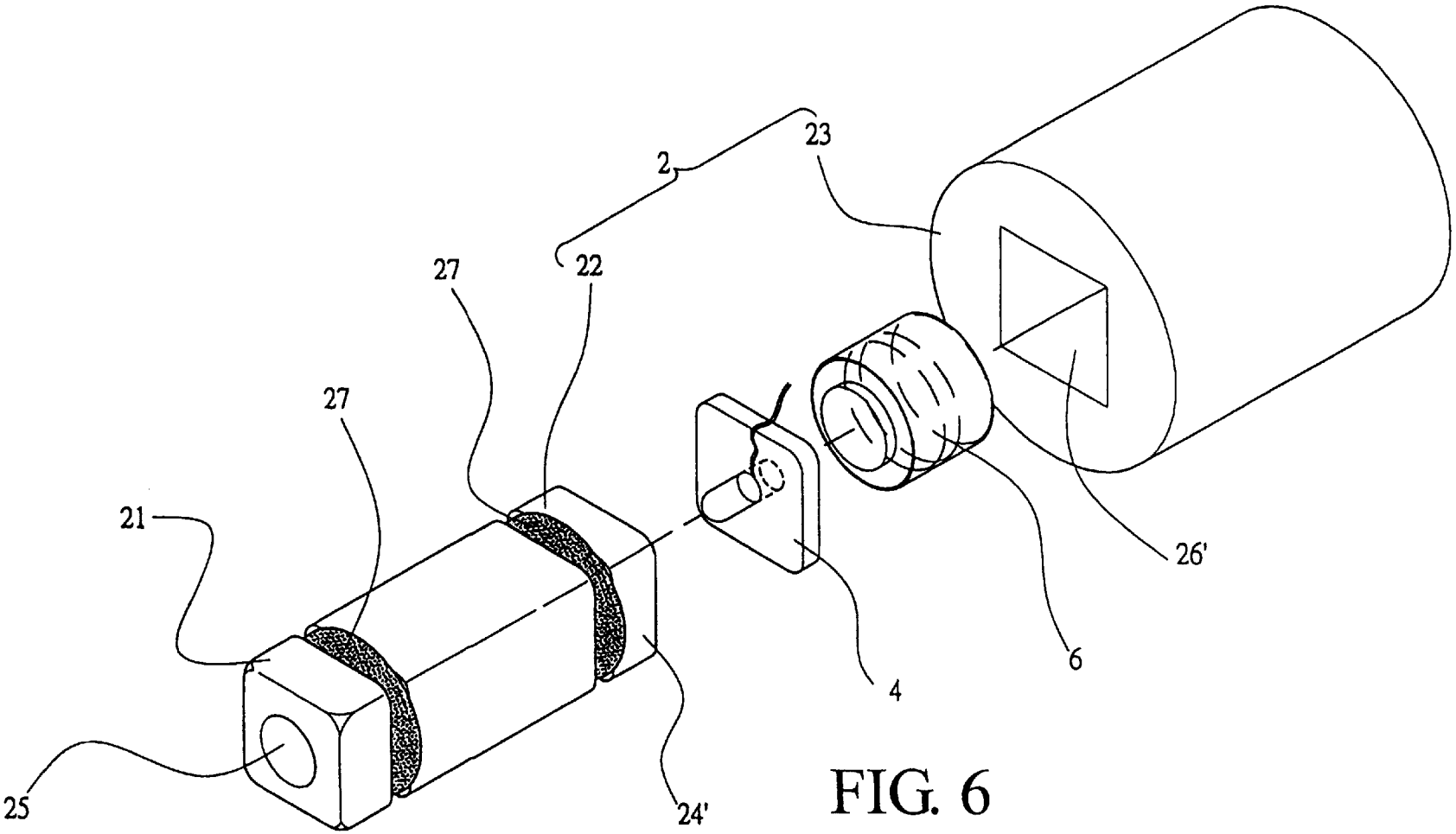
FIG. 6 is a perspective view of the linkage portion in another embodiment of the present invention.
Figure 7:
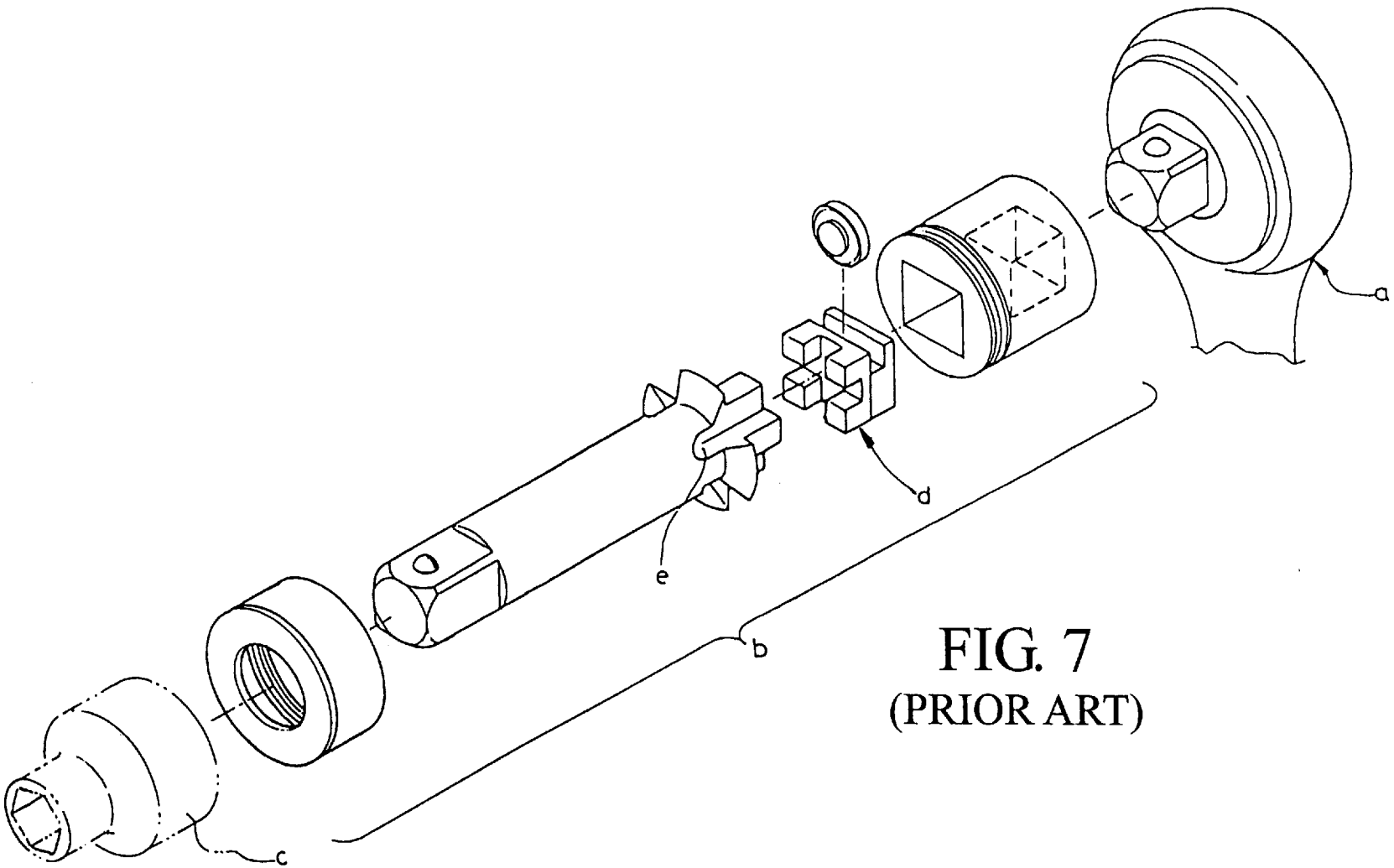
FIG. 7 (PRIOR ART)
FIG. 7 is a perspective view showing a prior art structure.

With reference to FIGS. 5 and 6, a different variation of the linkage portion in another embodiment according to the present invention is illustrated. In FIG. 5, the embedding head of front portion 22 of the linkage portion 2 is formed with a shape matching with a general cruciform opener and a flat head opener and thus is designed with an embedding hole 21'. While the through hole 25 for transmitting light is installed in the side shifted from the embedding hole 21'. The lamp 4 is moved laterally to a side. When this structure is used, the object of the present invention can also be achieved. Moreover, the rear end of the rear portion 23 in this embodiment may have a post shape or it may combine with a chuck or a handle 1 with a combining hole.

As shown in FIG. 6, another modified embodiment of the present invention is illustrated. The front portion 22 is made as a hollow post and is detachable, and the rear portion 23 is made as a concave combining groove 26' so that in the combining groove 26' may be sequentially installed with a battery 6 and a lamp 4. Then the battery and lamp are sealed by the junction 24' at the rear end of the front portion 22 so as to achieve the object of the present invention.

Although the present invention has been described using specified embodiments, the examples are meant to be illustrative and not restrictive. It is clear that many other variations would be possible without departing from the basic approach, demonstrated by the present invention.

I claim:

1. An assembled opener with an illumination device comprising a handle having a projection, a linkage portion including a front portion and a rear portion removably secured to each other, said rear portion of said linkage portion having a recess for removably receiving said projection of said handle therein, a tool portion removably secured to said front portion of said linkage portion, an illumination device installed within the linkage portion between the front portion and the rear portion, a polygonal combining groove formed on a rear side of the front portion of the linkage portion, a hole extending through the linkage portion to the tool portion, said hole being formed in a center of the combining groove, a front end of the rear portion of the linkage portion having a junction for mating with the combining groove, a depth of the junction being shorter than a depth of the combining groove, and a through hole formed in a center of the tool portion for allowing passage therethrough of light from said linkage portion.

2. The assembled opener with an illumination device as claimed in claim 1, wherein a plurality of slits in the front portion of the linkage portion facilitate connection of the front portion of the linkage portion with the tool portion.

3. An assembled opener with an illumination device comprising:

a handle, a linkage portion including a front portion and a rear portion removably secured to each other, said rear portion of said linkage portion being removably secured to said handle, an illumination device installed within the linkage portion between the front portion and the rear portion, the front portion of the linkage portion being formed in a shape of a post, and a front end of the rear portion of the linkage portion having a combining groove so that a lamp and battery set of said illumination device are sequentially arranged within the combining groove of the rear portion of the linkage portion, said front portion of said linkage portion being removably received in said combining groove of said rear portion of said linkage portion and said front portion of said linkage portion including a hole extending through said front portion from a rear end of said front portion to a front end of said front portion for passage of light from said illumination device.

4. An assembled opener with an illumination device comprising:

a handle, a linkage portion including a front portion and a rear portion removably secured to each other, said rear portion of said linkage portion being removably secured to said handle, a tool portion removably secured to said front portion of said linkage portion, an illumination device installed within the linkage portion between the front portion and the rear portion, a combining groove formed on a rear side of the front portion of the linkage portion, and a hole extending through the front portion of the linkage portion from the illumination device to the tool portion, said hole being located laterally from a center of the front portion of the linkage portion for passage of light to a side of a center of the linkage portion and to a side of a center of the tool portion.

* * * * *